US007412781B2

(12) United States Patent
Mattinger et al.

(10) Patent No.: US 7,412,781 B2
(45) Date of Patent: Aug. 19, 2008

(54) DEVICE FOR A HOT AIR SHOWER

(75) Inventors: Detlef Mattinger, Bickenbach (DE); Peter Scheunert, Dieburg (DE)

(73) Assignee: Wella AG, Darmstadt (DE)

( * ) Notice: Subject to any disclaimer, the term of this patent is extended or adjusted under 35 U.S.C. 154(b) by 0 days.

(21) Appl. No.: 10/520,305

(22) PCT Filed: Mar. 27, 2003

(86) PCT No.: PCT/EP03/03161

§ 371 (c)(1),
(2), (4) Date: Jan. 5, 2005

(87) PCT Pub. No.: WO2004/006712

PCT Pub. Date: Jan. 22, 2004

(65) Prior Publication Data

US 2005/0229422 A1 Oct. 20, 2005

(30) Foreign Application Priority Data

Jul. 10, 2002 (DE) ..... 102 31 058

(51) Int. Cl.
*A45D 1/00* (2006.01)

(52) U.S. Cl. ..... 34/96; 34/98; 392/380

(58) Field of Classification Search ..... 34/96, 34/97, 98, 283; 392/379–385; 219/222; 132/212; 239/418, 423, 518, 520, 538, 549, 239/568
See application file for complete search history.

(56) References Cited

U.S. PATENT DOCUMENTS 3,374,789 A * 3/1968 Maurer ..... 239/549

FOREIGN PATENT DOCUMENTS

| | | | |
|---|---|---|---|
| DE | 90 01 199.6 | | 7/1990 |
| DE | 9100860.3 | * | 5/1991 |
| EP | 0 970 633 A1 | | 1/2000 |
| FR | 1387334 | * | 12/1963 |

* cited by examiner

*Primary Examiner*—Jiping Lu
(74) *Attorney, Agent, or Firm*—Michael J. Striker

(57) ABSTRACT

The air nozzle attachment (8) for the hair dryer (2) is connectable to the blower opening (7) of the hair dryer and produces a hot-air stream (9) and a cold-air stream (10) that are arranged side-by-side. The air nozzle attachment (8) has a hot-air nozzle (13) and a cold-air nozzle (14) located side-by-side and, on an end connectable to the blower opening (7), has a central conduit entrance (11) and a coaxial conduit entrance (12), which open into the hot-air nozzle (13) and the cold-air nozzle (14) respectively. The air nozzle attachment (8) can be detached again from the dryer (2) and preferably has a snap-on coupling device (18) for connecting the air nozzle attachment to the dryer (2), which permits rotation of the air nozzle attachment.

9 Claims, 2 Drawing Sheets

DEVICE FOR A HOT AIR SHOWER

BACK GROUND OF THE INVENTION

The invention relates to a device for a hair dryer, having a fan and a heater, for generating a central hot-air stream and a concentric cold-air stream at a blower opening.

A hair dryer of this kind, for instance for drying or otherwise treating hair on the head, is known for instance from German Utility Model DE9001199U1. In it, a concentric cold-air stream from a blower opening of a hair dryer is meant to prevent the scalp from becoming excessively hot from the hot-air stream. A disadvantage here is that the concentric cold-air stream simultaneously strikes the hair on the head as well, which leads to unwanted cooling.

SUMMARY OF THE INVENTION

The object of the invention is therefore to create a device of this same generic type which does not have the aforementioned disadvantages and is simple in construction and can be produced economically.

This object and others, which will be made more apparent hereinafter, are attained in an air nozzle attachment for a hair dryer having a fan and a heater for producing said device comprising means for generating a central hot-air stream and a concentric cold-air stream at a blower opening.

According to the invention the air nozzle attachment is connectable to the blower opening and produces a hot-air stream and a cold-air stream from the central hot-air stream and the concentric cold-air stream of the hair dryer at the blower opening the hot-air stream and the cold-air stream produced by the air nozzle attachment are arranged side-by-side, the air nozzle attachment comprises a hot-air nozzle and a cold-air nozzle located side-by-side, the air nozzle attachment, on an end connectable with the blower opening, is provided with a central conduit entrance and a coaxial conduit entrance coaxial to the central conduit entrance, and the central conduit entrance opens into the hot-air nozzle and the coaxial conduit entrance opens into the cold-air nozzle.

Further advantageous features of the present invention will become apparent from various preferred embodiments described hereinbelow.

Preferably the air nozzle attachment is connectable to the blower opening by means of a snap-on coupling so that the air nozzle attachment can be again detached. Preferably the air nozzle attachment is axially connectable to the hair dryer at the blower opening so that it can be rotated to any angular position.

In a preferred embodiment of the present device the air nozzle attachment is made of heat resistant plastic.

Preferably the outer parts of the hot-air nozzle and the cold-air nozzle have different appearances so that they are easily visually distinguished. For example, an outer section of the hot-air nozzle can have a red color and an outer section of the cold-air nozzle can have a blue color.

The invention will be described in further detail in terms of an exemplary embodiment.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIENTS

Figure 1:
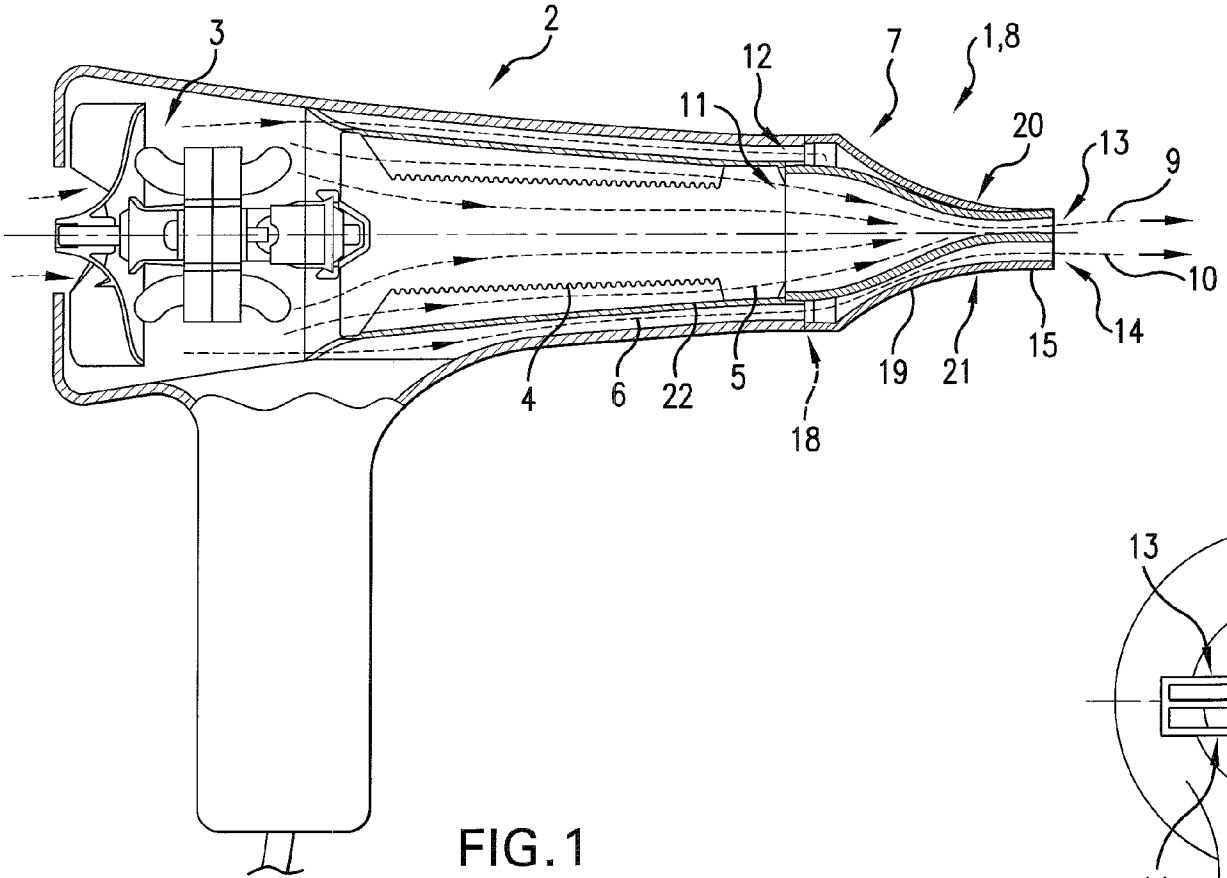
FIG. 1, in a side view in section, a hair dryer with a device embodied as an air nozzle attachment.
Figure 2:
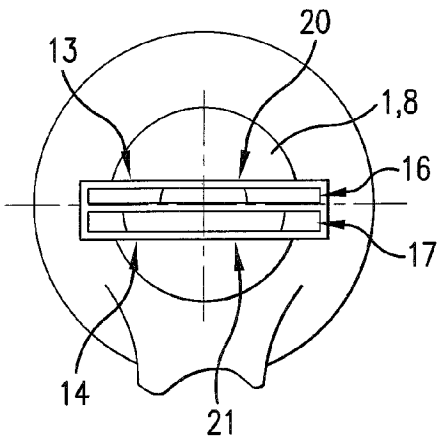
FIG. 2, in an axial end view on the air nozzle attachment, the hair dryer of FIG. 1.
Figure 3:
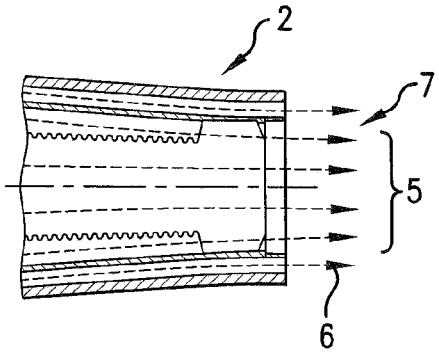
FIG. 3, in a sectional fragmentary view, the front region of the hair dryer of FIG. 1, but without an air nozzle attachment.
Figure 4:
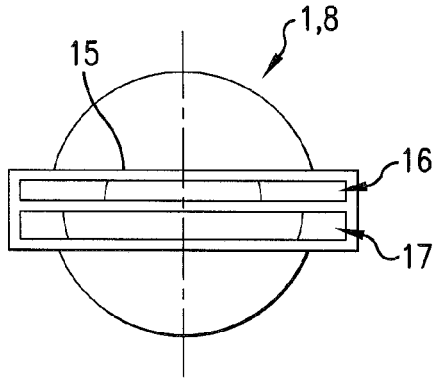
FIGS. 4 through 6, in various, slightly enlarged views, the air nozzle attachment as an individual part.
Figure 5:
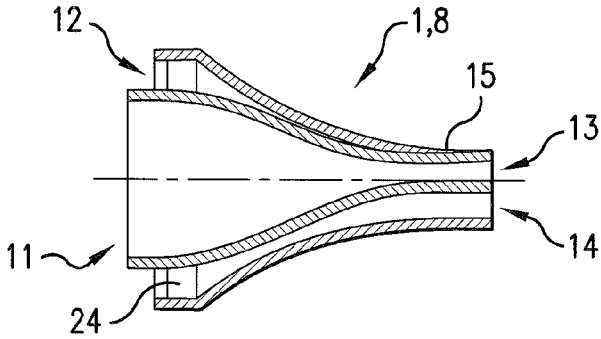
Figure 6:
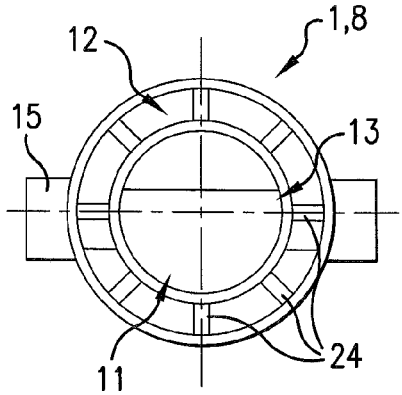

FIGS. 1 through 6 show a device 1 for a hair dryer 2, having a fan 3 and a heater 4 for generating a central hot-air stream 5 and a concentric cold-air stream 6 at a blower opening 7, and in the region of the heater 4, the hot-air stream 9 and the cold-air stream 10 are separated by a partition 22. As the device 1, an air nozzle attachment 8 embodied as connectable to the blower opening 7 is provided of a kind such that the air nozzle attachment 8, from the central hot-air stream 5 and the concentric cold-air stream 6 of the hair dryer 2, generates a hot-air stream 9 and a cold-air stream 10 that are located side by side. The air nozzle attachment 8, on the end with the blower opening 7, has a central conduit entrance 11 and a coaxial conduit entrance 12, and the central conduit entrance 11 discharges into a hot-air nozzle 13 and the coaxial conduit entrance 12 discharges into a cold-air nozzle 14, and the hot-air nozzle 13 and the cold-air nozzle 14 are located side by side. The central conduit entrance 11 and the coaxial conduit entrance 12 are joined together by means of connecting struts 24.

The hot-air nozzle 13 and the cold-air nozzle 14 are each designed as a flat nozzle 15 and are each located with one flat side against one another; the hot-air nozzle 13 and the cold-air nozzle 14 have at least approximately the same blower cross section 16, 17.

In embodients in which the hot-air nozzle has a smaller blower cross section 16 than the blower cross section 17 of the cold-air nozzle 14, very good cooling of a scalp is attained.

For practical reasons, the hot-air nozzle 13 and the cold-air nozzle 14 end at the same length.

Because the air nozzle attachment 8 is embodied as being axially rotatably connectable in the region of the blower opening 7, the air nozzle attachment 8 can be positioned in any angular position, simplifying manipulation of the hair dryer 2 such that areas of the hair on the side of the head, especially, can be treated optimally and in an aimed manner with the air nozzle attachment 8.

The air nozzle attachment 8 is connectable with the region of the blower opening 7 by means of a snap-on connection 18, which is known per se and not shown in further detail, that can be detached again.

For reasons of cost, the air nozzle attachment 8 comprises heat-resistant plastic 19.

For simple visual monitoring of the air nozzle attachment 8 adjusted to a particular angle of rotation, the outer parts of the hot-air nozzle 13 and of the cold-air nozzle 14 are identified visually differently, for instance by providing that the outer part 20 of the hot-air nozzle 13 is identified by a red color, and the outer part 21 of the cold-air nozzle 14 is identified by a blue color.

Figure 7:
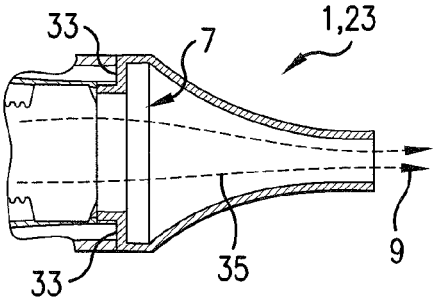
FIG. 7, in a sectional side view, a further air nozzle attachment for only hot air.

FIG. 7 shows a further air nozzle attachment 23, which produces only a hot-air stream 9, 35. Because a hot-air nozzle attachment 23 is provided for the air nozzle attachment 8 for optional use, it is optionally possible to generate solely a hot-air stream 9 with the hair dryer 2. The hot-air stream 9 only is produced by the further air nozzle attachment 23 by closing the blower evening 7 at 33 in FIG. 7 to the concentric cold-air stream 6. Thus only the hot-air stream 9 is allowed to pass through it.

LIST OF REFERENCE NUMERALS

1 Device
2 Hair dryer
3 Fan
4 Heater
5 Central hot-air stream
6 Concentric cold-air stream
7 Blower opening
8 Air nozzle attachment
9 Hot-air stream
10 Cold-air stream
11 Central conduit entrance
12 Coaxial conduit entrance
13 Hot-air nozzle
14 Cold-air nozzle
15 Flat nozzle
16 Blower cross section of hot-air nozzle
17 Blower cross section of cold-air nozzle
18 Snap-on connection
19 Plastic
20 Outer part of hot-air nozzle
21 Outer part of cold-air nozzle
22 Partition
23 Hot-air nozzle attachment
24 Connecting strut

The invention claimed is:

1. A hair dryer (2) having a fan and a heater for generating a central hot-air stream and a cold-air stream concentric to the central hot-air stream at a blower opening (7), a first air nozzle attachment, and a second air nozzle attachment (23) for optional usage;

wherein said second air nozzle attachment (23) only produces a hot air stream (9), and wherein said first air nozzle attachment (8) is connectable to the blower opening (7) and produces a hot-air stream (9) and a cold-air stream (10) from said central hot-air stream (5) and said concentric cold-air stream (6), wherein said hot-air stream (9) and said cold-air stream (10) produced by the first air nozzle attachment (8) are arranged side-by-side, wherein the air nozzle attachment (8) comprises a hot-air nozzle (13) and a cold-air nozzle (14) located side-by-side, wherein the first air nozzle attachment (8), on an end connectable with the blower opening (7), is provided with a central conduit entrance (11) and a coaxial conduit entrance (12) coaxial to the central conduit entrance (11), and wherein the central conduit entrance (11) opens into the hot-air nozzle (13) and the coaxial conduit entrance (12) opens into the cold-air nozzle (14) and wherein the first air nozzle attachment (8) is detachable from the blower opening (7).

2. The hair dryer as defined in claim 1, wherein the hot-air nozzle (13) and the cold-air nozzle (14) are each formed as a flat nozzle (15) and the hot-air nozzle (13) and the cold-air nozzle (14) have respective flat sides on each other.

3. The hair dryer as defined in claim 1, wherein the hot-air nozzle (13) and the cold-air nozzle (14) have at least approximately equal blower cross sections (16,17).

4. The hair dryer as defined in claim 1, wherein the hot-air nozzle (13) has a smaller blower cross-section (16) than a blower cross section (17) of the cold-air nozzle (14).

5. The hair dryer as defined in claim 1, wherein the hot-air nozzle (13) and the cold-air nozzle (14) end at the same length.

6. The hair dryer as defined in claim 1, wherein the first air nozzle attachment (8) is axially connectable to the hair dryer (2) in the region of the blower opening (7) so as to be rotatable to any angular position.

7. The hair dryer as defined in claim 1, wherein the first air nozzle attachment (8) comprises heat-resistant plastic (19).

8. The hair dryer as defined in claim 1, wherein an outer part of the hot-air nozzle (13) and an outer part of the cold-air nozzle (14) have different visual appearances and are visually distinguishable from each other.

9. The hair dryer as defined in claim 8, wherein the outer part (20) of the hot-air nozzle (13) has a red color, and the outer part (21) of the cold-air nozzle (14) has a blue color, whereby the hot-air nozzle (13) and the cold-air nozzle (14) are visually distinguishable from each other.

* * * * *